United States Patent [19]

Rudenauer et al.

[11] Patent Number: 4,658,725

[45] Date of Patent: Apr. 21, 1987

[54] FUSE FOR A SMALL BOMB

[75] Inventors: Werner Rudenauer, Roth; Wilhelm Furst, Buchberg; Erwin Haas, Happurg, all of Fed. Rep. of Germany

[73] Assignee: Diehl GmbH & Co., Nuremberg, Fed. Rep. of Germany

[21] Appl. No.: 797,702

[22] Filed: Nov. 13, 1985

[30] Foreign Application Priority Data

Dec. 19, 1984 [DE] Fed. Rep. of Germany ... 8437159[U]

[51] Int. Cl.[4] ..... F42B 13/50; F42B 25/16; F42C 15/32

[52] U.S. Cl. ..... 102/229; 102/223; 102/254; 102/393; 102/489; 102/251

[58] Field of Search ..... 102/489, 256, 251, 247, 102/254, 229, 222, 223, 393

[56] References Cited

U.S. PATENT DOCUMENTS

| | | | |
|---|---|---|---|
| 3,392,672 | 7/1968 | Noles | 102/256 |
| 3,532,057 | 10/1970 | Aubrey | 102/229 |
| 3,744,424 | 7/1973 | Popper et al. | 102/251 X |
| 3,962,974 | 6/1976 | Anderson et al. | 102/229 X |
| 4,393,780 | 7/1983 | Zacharin | 102/256 X |
| 4,455,940 | 6/1984 | Furuike | 102/489 X |
| 4,498,393 | 2/1985 | Fischer et al. | 102/489 X |

FOREIGN PATENT DOCUMENTS

| | | | |
|---|---|---|---|
| 1912750 | 10/1970 | Fed. Rep. of Germany . | |
| 2523644 | 12/1976 | Fed. Rep. of Germany . | |
| 3045521 | 7/1982 | Fed. Rep. of Germany | 102/489 |
| 2140693 | 1/1973 | France . | |

*Primary Examiner*—David H. Brown

*Attorney, Agent, or Firm*—Scully, Scott, Murphy & Presser

[57] ABSTRACT

A fuse or triggering device for a small bomb arranged in an artillery grenade, which includes a percussion fuse constituted of a striker and a detonator. The above-mentioned artillery grenade contains a plurality of small bombs arranged behind each other, which are ejected at a predetermined point in the trajectory of the artillery grenade. Each small bomb possesses an autonomous fuse. A slider containing the detonator is secured in a safety position, in that the slider lies against an outwardly pivotable securing lever which lies resiliently prestressed against the inner wall of a further small bomb, and in which the striker is fixed in position between the slider and a securing disc which is deformable in response to the firing acceleration of the artillery grenade.

1 Claim, 3 Drawing Figures

FUSE FOR A SMALL BOMB

BACKGROUND OF THE INVENTION

Field of the Invention

The present invention relates to a fuse or triggering device for a small bomb arranged in an artillery grenade, which includes a percussion fuse constituted of a striker and a detonator.

The above-mentioned artillery grenade contains a plurality of small bombs arranged behind each other, which are ejected at a predetermined point in the trajectory of the artillery grenade. Each small bomb possesses an autonomous fuse.

SUMMARY OF THE INVENTION

Accordingly, it is an object of the present invention to provide a simple fuse for a small bomb which includes two securing or safety devices which are mutually independent of each other.

The foregoing object is achieved through a fuse for a small bomb of the type described herein in which a slider containing the detonator is secured in a safety position, in that the slider lies against an outwardly pivotable securing lever which lies resiliently prestressed against the inner wall of a further small bomb, and in which the striker is fixed in position between the slider and a securing disc which is deformable in response to the firing acceleration of the artillery grenade.

It is an important aspect of the invention that the interconnection of the small bombs with each other and the oncoming airflow acting on the securing lever represent mutually independent arming criteria. This object is attained through the employment of simple, constructive media. Thus, for the detonation of the small bomb it is necessary that it has detached itself from the neighboring small bomb and possesses a corresponding amount of energy, which is then employed for arming; in effect, through the oncoming airflow acting on the securing lever.

BRIEF DESCRIPTION OF THE DRAWINGS

Reference may now be had to exemplary embodiments of the invention, taken in conjunction with the accompanying drawings; in which.

DETAILED DESCRIPTION

Figure 1:
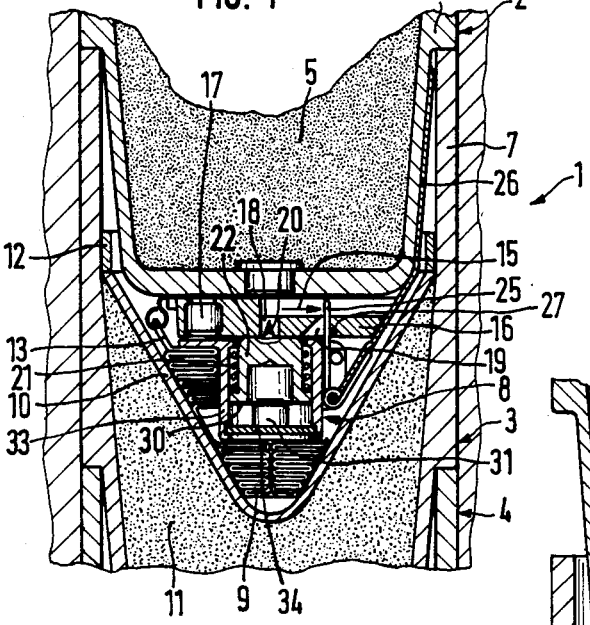
FIG. 1 illustrates a longitudinal sectional view through small bombs which are bound within an artillery grenade.

Arranged within an artillery grenade 1 in stacked relationship behind each other are a plurality of small bombs 2 through 4. The small bomb 2, which is alone described herein in detail, possesses a shell or casing 6 which is filled with an explosive 5, and wherein the casing 6 has at its end surface contact against a casing 7 of the small bomb 3.

The casing 7 encompasses a portion of the small bomb 2 including a fuse 8, as well as completely encompassing a folded parachute 9 with the shroudlines 13 of the small bomb 2.

The fuse 8 is primarily located within a hollow charge liner or jacket 10 for an explosive charge 11 of the small bomb 3. The liner 10 is fixed through the intermediary of a ring 12 within the casing 7.

The fuse 8 consists of a slider 16 which is movable in the direction of the arrow 15. The slider 16 contains a contact-sensitive detonator 17, and possesses openings 18 and 19 for the primer or firing pin 20 of a striker 22 which is movable opposite a spring force, and for an engaging lever 25.

The lever 25 is connected to with a securing lever 26 so as to be rotatable therewith. The securing lever 26 consist of sheet metal or spring plate and lies in a prestressed condition against the casing 7.

The striker 22 lies against a deformable securing disc 30. The securing disc 30 is fastened to a post 31 of a plate 34 which is flanged into a housing 33.

Figure 2:
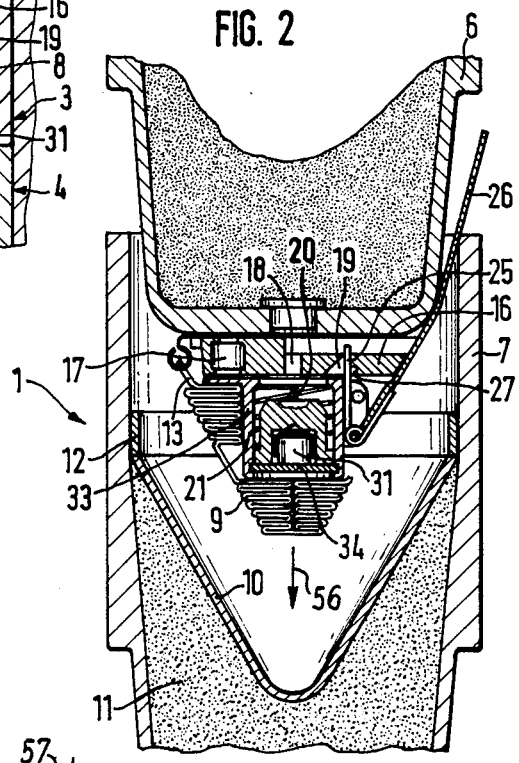
FIGS. 2 and 3 illustrate, respectively, two different phases in the movement of the arrangement of FIG. 1.
Figure 3:
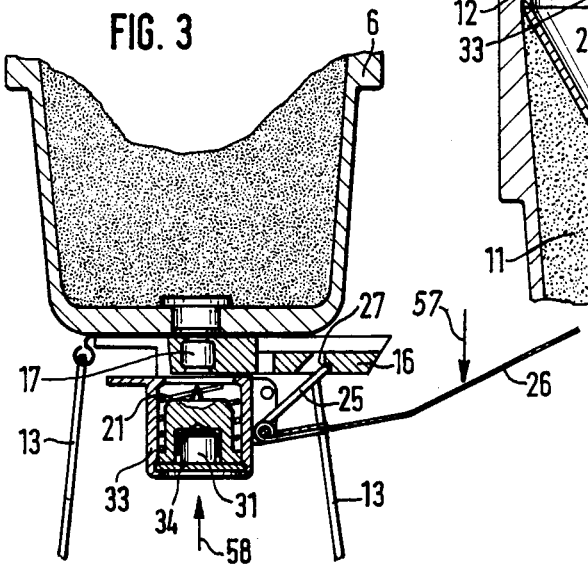

The function of the fuse can be ascertained from FIGS. 2 and 3. Upon the firing of the artillery projectile 1 from a suitable weapon (not shown), as a result of the firing acceleration, the securing disc 30 is deformed by the striker 22, as shown in FIG. 2, whereby the striker 22 is moved in the direction of arrow 56. Hereby, the firing pin 20 is disengaged from the slider 16. The spring 21 retains the striker 22 in the position as illustrated in FIG. 2.

There now follows the separating sequence among the small bombs 2 through 4. When the small bombs 2 and 3 have detached from each other, the prestressed securing lever 26 swings radially outwardly, such that the lever is exposed to the oncoming airflow, as shown by the arrow 57. The force of the oncoming airflow will then tear or pull the securing lever 26 in the direction of arrow 56. The securing lever 26 then slides the slider 16 through the engaging lever 25 into the armed position, as shown in FIG. 3.

When the slider 16 stands in the armed position, the securing lever 26 will snap out and fly away. The lever 25 secures the slider through engagement in a step or notch 27.

The fuse 8 is now completely armed. Upon striking a target, the striker 22 will then move in response to the deceleration in the direction of arrow 58 and impact against the detonator 17. This will then cause the triggering of the explosive charge 5.

What is claimed is:

1. In a fuse for a small bomb arranged in an artillery grenade including a plurality of said small bombs positioned in an axially stacked relationship, said fuse including a percussion fuse consisting of a striker and a detonator; the improvement comprising: a slider containing the detonator; a radially outwardly pivotable securing lever interposed between said bombs and contacting an inner wall of an adjoining bomb, said slider contacting securing lever, said securing lever maintaining said detonator in a secured position; a securing disc being articulated to said securing lever; said striker being fixed in position between the slider and said securing disc; resilient biasing means for effecting an outward pivoting movement of said securing lever upon separation of said bombs responsive to the firing acceleration of the artillery grenade, so as to displace said slider and deform said securing disc whereby said detonator is set into an armed condition.

* * * * *